US007653966B2

(12) United States Patent
Quinn et al.

(10) Patent No.: US 7,653,966 B2
(45) Date of Patent: Feb. 2, 2010

(54) SLIDING RAIL ASSEMBLY FOR A SLIDING PANEL MOVABLE ALONG A TRACK

(75) Inventors: Don Quinn, Rice Lake, WI (US); Robert C. Martineau, Chippewa Falls, WI (US); Jeff V. Sawyers, Rice Lake, WI (US)

(73) Assignee: Quanex Corporation, Houston, TX (US)

( * ) Notice: Subject to any disclaimer, the term of this patent is extended or adjusted under 35 U.S.C. 154(b) by 557 days.

(21) Appl. No.: 11/405,813

(22) Filed: Apr. 18, 2006

(65) Prior Publication Data

US 2006/0230575 A1 Oct. 19, 2006

Related U.S. Application Data

(60) Provisional application No. 60/672,891, filed on Apr. 19, 2005.

(51) Int. Cl.
*E05D 15/06* (2006.01)
*A47H 15/00* (2006.01)

(52) U.S. Cl. ..... 16/96 R; 16/87.6 R; 16/93 R; 16/94 R; 16/87.8

(58) Field of Classification Search ..... 16/96 R, 16/93 R, 94 R, 87.2, 87.8; 4/557, 607, 610; 49/410, 425, 413, 428; 160/330, 345, 346, 160/199, 206
See application file for complete search history.

(56) References Cited

U.S. PATENT DOCUMENTS 1,260,858 A 3/1918 Beeman
1,349,398 A 8/1920 Weis
1,411,561 A 4/1922 Beeman
1,444,349 A * 2/1923 Leeds ..... 16/100
1,621,717 A 3/1927 Grant et al.
2,761,150 A 9/1956 Kellogg
2,835,539 A * 5/1958 Conrad ..... 384/42
2,869,187 A 1/1959 Liebman et al.
2,897,514 A 8/1959 Collins
3,047,934 A 8/1962 Magner, Jr.
3,071,825 A 1/1963 Ferris
3,119,644 A 1/1964 Workman
3,185,111 A 5/1965 Hess et al.
3,324,597 A 6/1967 Rich
3,724,778 A * 4/1973 Kuhnlein et al. ..... 242/338
3,823,439 A * 7/1974 Selset ..... 16/94 D
3,837,119 A * 9/1974 Conneally et al. ..... 49/404
3,978,617 A * 9/1976 Eventoff ..... 49/404
4,222,427 A 9/1980 Buchner
4,229,905 A 10/1980 Rush
4,359,080 A 11/1982 Brydolf
4,412,703 A 11/1983 Simonson (Continued)

*Primary Examiner*—Chuck Y. Mah
(74) *Attorney, Agent, or Firm*—Howard & Howard Attorneys PLLC

(57) ABSTRACT

A sliding rail assembly (20) for a sliding panel (22), movable along a track (24) between open and closed positions, includes a runner (26) and a glide (28) for sliding engagement along the runner (26). The runner (26) is adapted to extend from the track (24). The glide (28) has an interior surface (64) disposed about the runner (26) and an exterior surface (62) adapted to extend from the sliding panel (22). A layer of polymeric material (48) is secured by an adhesive (90) to either one of the interior surface (64) of the glide (28), the runner (26), or both for facilitating sliding movement of the glide (28) along the runner (26).

30 Claims, 9 Drawing Sheets

U.S. PATENT DOCUMENTS

| | | | | | |
|---|---|---|---|---|---|
| 4,488,387 | A | | 12/1984 | Foti | |
| 4,574,526 | A | * | 3/1986 | Lindquist | 49/411 |
| 4,633,614 | A | * | 1/1987 | Van Weelden | 49/409 |
| 4,773,769 | A | | 9/1988 | Chruch | |
| 4,800,619 | A | * | 1/1989 | Hudak | 16/95 R |
| 4,803,809 | A | | 2/1989 | Takemura | |
| 4,819,297 | A | | 4/1989 | Jacobs et al. | |
| 5,421,059 | A | * | 6/1995 | Leffers, Jr. | 16/87.4 R |
| 5,890,811 | A | | 4/1999 | Bryson | |
| 5,962,146 | A | | 10/1999 | Betremieux et al. | |
| 5,974,667 | A | | 11/1999 | Bryson | |
| 6,131,340 | A | * | 10/2000 | Clark et al. | 49/410 |
| 6,158,123 | A | | 12/2000 | Bryson | |
| 6,324,789 | B1 | | 12/2001 | Stephen | |
| 6,381,904 | B1 | | 5/2002 | Tedescucci | |
| 6,408,922 | B2 | | 6/2002 | Desrochers | |
| 6,925,681 | B2 | | 8/2005 | Lin | |
| 7,010,830 | B2 | * | 3/2006 | Sirochman | 16/93 R |
| 2001/0035268 | A1 | | 11/2001 | Desrochers | |

* cited by examiner

SLIDING RAIL ASSEMBLY FOR A SLIDING PANEL MOVABLE ALONG A TRACK

CROSS REFERENCE TO RELATED APPLICATION

This application claims the benefit of U.S. provisional patent application Ser. No. 60/672,891, filed Apr. 19, 2005.

BACKGROUND OF THE INVENTION

1. Field of the Invention

The invention generally relates to a sliding rail assembly for a sliding panel movable along a track. More specifically, the invention relates to using polymeric material to facilitate sliding movement of the panel along the track.

2. Description of the Related Art

Traditional assemblies for moving a panel include a surround which defines an opening and a pair of tracks which are disposed on opposite sides of the opening. The panel, such as a window or a door, is attached to the tracks and the panel is moved along the tracks to cover and uncover the opening. In these traditional assemblies, a guide ridge is typically formed along each of the tracks. Rollers are disposed on opposite sides of the panel for rolling the panel along the respective guide ridges. When the rollers are not in alignment with the guide ridges of the tracks, such as when the panel becomes warped or the tracks are out of alignment with respect to each other, which is a common result of poor installation or a subsequent accident dislodging the assembly, the assembly becomes difficult to move across the opening, i.e., binds, or the rollers become dislodged from the track.

Some assemblies have been developed to prevent the panel from binding or becoming dislodged from the tracks by incorporating a sliding rail assembly. An example of a sliding rail assembly which helps to prevent the panel from binding or becoming dislodged from the track is disclosed in U.S. Pat. No. 4,819,297 to Jacobs et al. (the '297 patent). The '297 patent discloses a surround defining an opening with a track disposed along a top of the opening. The track is formed from metal and includes a mounting plate with a runner having an L-shaped cross-section depending from the mounting plate. A glide is in sliding engagement with the track and attached to a top of the panel for supporting the panel while the glide and the panel slide along the runner of the track to cover and uncover the opening. The glide includes a finger and a hip spaced from the finger. The finger and the hip present a cross-section having an exterior surface and an interior surface disposed about the L-shaped cross-section of the rail for sliding engagement between the rail and the glide. The entire glide is formed from an injection molded plastic material. The glide is assembled to the track by fitting the hip over the L-shaped cross-section of the runner and rotating the glide about the runner and in sliding engagement. As the glide is rotated into place, the finger flexes, which allows the glide to surround and engage the runner. The plastic material will have the tendency to wear. This is because the plastic material of the glide slides along the metal track. Additionally, the hip supports the weight of the panel as the glide slides along the runner of the track. However, because the glide is formed entirely from the plastic material which is designed to flex, the glide limits the weight of the panel to which it may be attached in order for the track to support the load from the glide and the panel. Therefore, if a heavy panel is used, which would cause the glide to flex, a secondary track, which would include rollers along a bottom edge of the panel, must be incorporated to support the load of the panel while the glide and the runner act as only a guide at the top of the panel for guiding the panel across the opening.

Although the assembly described in the 297 patent eliminates the requirement of rollers on a track by using a glide sliding on the rail, there remains an opportunity for a sliding rail assembly which provides a rail and a glide which are capable of supporting heavy panels at only one end of the panel while still reducing the wear between the rail and the glide during sliding movement of the glide along the runner.

SUMMARY OF THE INVENTION AND ADVANTAGES

The present invention is a sliding rail assembly for a sliding panel movable along a track between open and closed positions. The sliding rail assembly includes a runner adapted to extend from the track. A glide presents a cross-section having an exterior surface adapted to extend from the sliding panel and an interior surface with the interior surface disposed about the runner for sliding engagement along the runner. A first layer of polymeric material is secured to at least one of the interior surface of the glide and the runner for facilitating sliding movement of the glide along the runner. A first adhesive is disposed between the first layer of polymeric material and at least one of the interior surface of the glide and the runner for adhesively securing the first layer of polymeric material to the one of the interior surface of the glide or the runner.

The use of the adhesive allows the polymeric material to bond to at least one of the interior surface of the glide and the runner. Therefore, the polymeric material would not otherwise bond to the interior surface of the glide or the runner without the adhesive. By securing the layer of polymeric material to at least one of the interior surface of the glide and the runner, the glide slides smoothly across the runner. The layer of polymeric material allows the glide and the runner to be formed from a strong material, i.e., aluminum, stainless steel, etc. The strong material allows the runner and the glide to support the load of the sliding panel at only one end while providing good wear resistance between the glide and the runner. Additionally, the sliding movement of the glide across the runner eliminates the need for rollers to support the load of the panel, which eliminates the number of moving parts in the assembly.

Additionally, the runner extends along a first axis and includes a pair of arcs which present an arcuate cross-section with the arcs extending in opposite directions transverse to the first axis. The first axis bisects the arcs. The glide is adapted to extend from the sliding panel and presents a C-shaped cross-section which extends to opposing ends with the glide defining a C-shaped cavity. The glide has an exterior surface and an interior surface with the interior surface facing the C-shaped cavity. A second axis bisects the C-shaped cross-section of the glide. The glide at least partially encapsulates the runner with the ends disposed about the arcs and the ends are rotatable about the arcs such that the first axis can be misaligned relative to the second axis.

Because the glide at least partially encapsulates the runner when the first and the second axes are aligned, the glide and the first axis are allowed to pivot with respect to the runner and the first axis to assist in assembly of the panel to the glide and within the opening. Therefore, when the runner is attached to the track and the glide is attached to the runner, the panel can be attached to and/or detached from the glide without first detaching the runner from the track. This reduces the complexity associated with making repairs or adjustments to the sliding rail assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
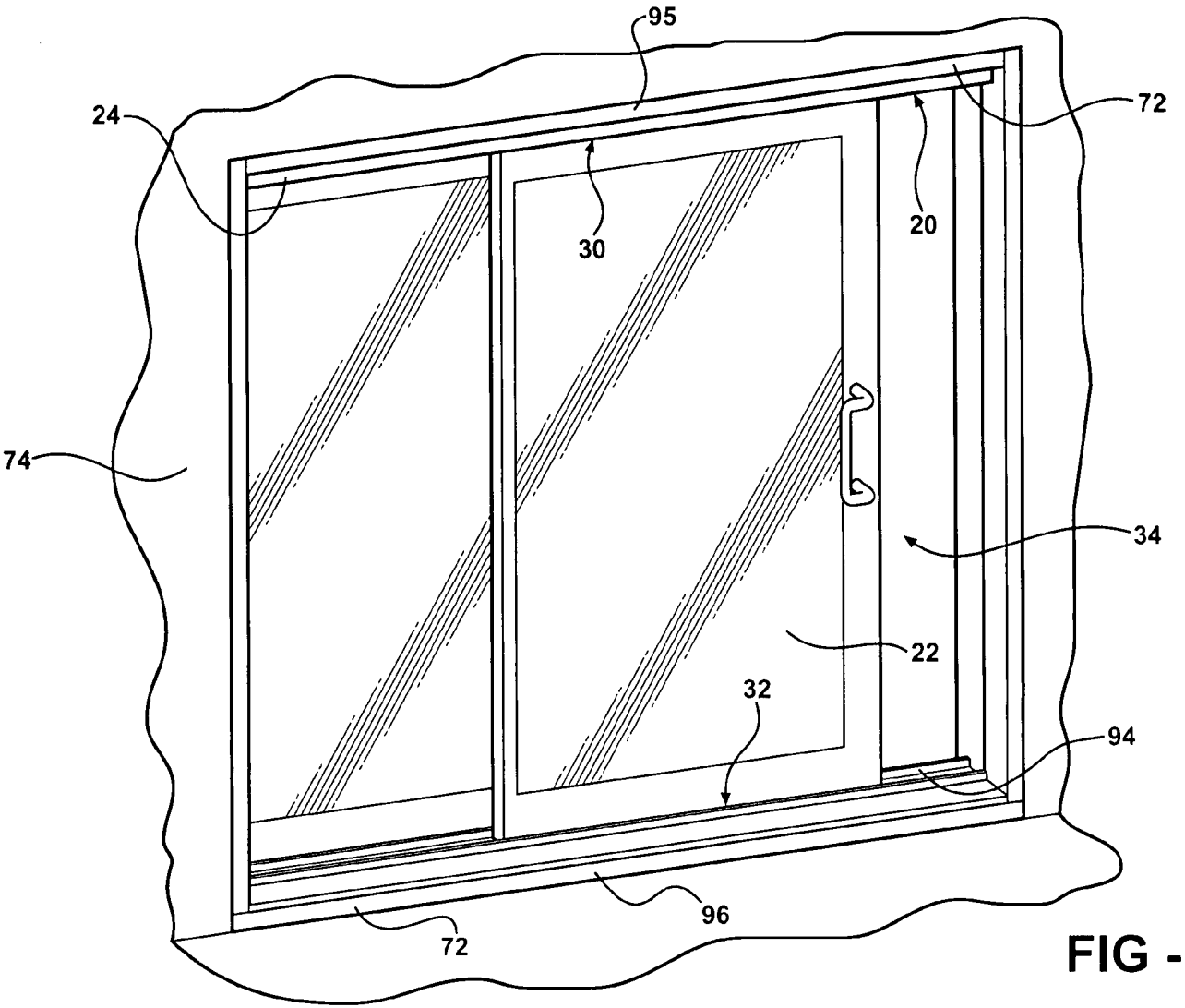
FIG. 1 is perspective view of a surround defining an opening in a structure and including a track attached to a top of the surround, a sliding rail assembly attached to the track, and a sliding panel attached to the sliding rail assembly.

The present invention relates to a sliding rail assembly 20 for a sliding panel 22 movable along a track 24 between an open and a closed position. The assembly is shown generally at 20 in FIG. 1. The assembly 20 includes a runner 26 adapted to extend from the track 24 and a glide 28 for sliding engagement along the runner 26 and adapted to extend from the sliding panel 22. The sliding panel 22 is a screen door, a glass door, a window, or any other type of panel for covering and uncovering an opening 34.

Referring again to FIG. 1, a surround 72 defines the opening 34 within a structure 74, such as a wall of a house, and the track 24 is mounted to a top or a bottom of the surround 95, 96. A typical track 24 is shown in FIG. 2, which has a U-shaped cross-section including a bottom 78 and a pair of sides 80 extending perpendicularly from the bottom 78 in spaced and parallel relationship. However, the track 24 is not limited to being shaped as a U-shaped cross-section and is any suitable shape which provides an attachment surface for attaching a mounting platform 36 to the track 24. Sometimes, the track 24 was previously installed within the surround 72 for use with rollers which were originally attached to the sliding panel 22. In these instances, the track 24 typically includes a guide ridge 82 extending perpendicularly from the bottom 78 of the track 24 and the rollers attached to a bottom 32 of the sliding panel 22 for straddling and rolling along the guide ridge 82. To adapt the mounting platform 36 to fit the track 24 which has the guide ridge 82, the mounting platform 36 includes a center arch 84 and side feet 86 as viewed in cross-section for disposition of the center arch 84 over the guide ridge 82 in the track 24. However, the center arch 84 and side feet 86 are also used on the track 24 when the guide ridge 82 is not present. Additionally, the mounting platform 36 is not limited to having the center arch 84 and side feet 86, but is any shape and configuration which facilitates attachment to the track 24. Additionally, the mounting platform 36 defines at least one mounting hole 88 for attaching the mounting platform 36 to the bottom 78 of the track 24. Any acceptable type of mounting fastener 89 may be used, such as a screw, for attaching of the mounting platform 36 to the track 24.

Referring again to FIG. 2, the mounting platform 36 extends from the track 24. The mounting platform 36 may be integral or attached to the track 24. Preferably, a post 38, which extends along a first axis 40, interconnects the runner 26 and the mounting platform 36. Although the post 38 is optional, if present, it may be integral or attached to the runner 26 and/or the mounting platform 36. The runner 26 extends from the post 38 and includes a pair of arcs 42 presenting an arcuate cross-section. The arcs 42 extend in opposite directions, transverse to the post 38 to respective tips 44, with the first axis 40 bisecting the arcuate cross-section. The runner 26 includes a midpoint 46 and is connected to the post 38 at the midpoint 46. The arcs 42 preferably curve away from the mounting platform 36, but may also curve toward the mounting platform 36 as long a there is sliding engagement between the glide 28 and the runner 26. The mounting platform 36, the post 38, and the runner 26 are preferably roll formed from aluminum, stainless steel, or another type of suitable metal which may be roll formed. However, this formation is not limited to a roll forming, but may be formed by any suitable process using any suitable material to achieve the desired shape. The material and the process chosen for forming these components should provide the mounting platform 36, the post 38, and the runner 26 with strength under loads attributed to sliding panel 22 and the use thereof such that bending and breakage of the mounting platform 36, the post 38, and the runner 26 do not occur under typical usage. Additionally, the mounting platform 36, the post 38, and the runner 26 are preferably formed as a single integral component. However, this formation is not limited to a single integral component, but may also be formed by assembling these individual components together with fasteners, welding, or any other suitable method of assembly.

The glide 28 includes a base 52 and a pair hooks 54 extending from the base 52 in a spaced and mirrored relationship to respective ends 56. The base 52 and the hooks 54 present a C-shaped cross-section which extends to the ends 56 with a second axis 58 bisecting the C-shaped cross-section. The base 52, the hooks 54, and the ends 56 define a C-shaped cavity 60 which has an exterior surface 62 and an interior surface 64 with the base 52, the hooks 54, the ends 56 and the interior surface 64 facing the C-shaped cavity 60. The hooks 54 of the C-shaped cross-section define a slot 66 which extends into the C-shaped cavity 60 between the ends 54. The interior surface 64 is disposed about the runner 26 for sliding engagement with the runner 26. Therefore, the glide 28 at least partially encapsulates the runner 26 with the hooks 54 and the ends 56 disposed about the arcs 42. Encapsulation of the runner 26 is to be understood as surrounding or enclosing the runner 26 within the glide 28. A flange 68 extends from the exterior surface 62 of the glide 28 and defines at least one fastening hole 70 for attachment to a top 30 of the sliding panel 22. The flange 68 is attached to the sliding panel 22 using a fastener, such as a rivet, or any other suitable type of fastener. By virtue of the hooks 54 being disposed about the arcs 42, the arcs 42 support the glide 28 and the sliding panel 22, which is attached to the flange 68. Additionally, when the runner 26 is disposed in the C-shaped cavity 60 of the glide 28, the post 38 extends through the slot 66, between the ends 56. The glide 28 and the flange 68 are preferably roll formed from aluminum, stainless steel, or another type of suitable metal which may be roll formed. However, the formation is not limited to a roll forming, but may be formed by any suitable process using any suitable material may be used to achieve the desired shape. The material and the process chosen for forming these components should provide the glide 28 and the flange 68 with strength under loads attributed to the sliding panel 22 and the use thereof such that bending and breakage of the glide 28 and the flange 68 do not occur under typical usage. Additionally, the glide 28 and the flange 68 are preferably formed as a single integral component. However, this formation is not limited to a single integral component, but may also be formed by assembling these individual components together with fasteners, welding, or any other suitable method of assembly.

Figure 2:
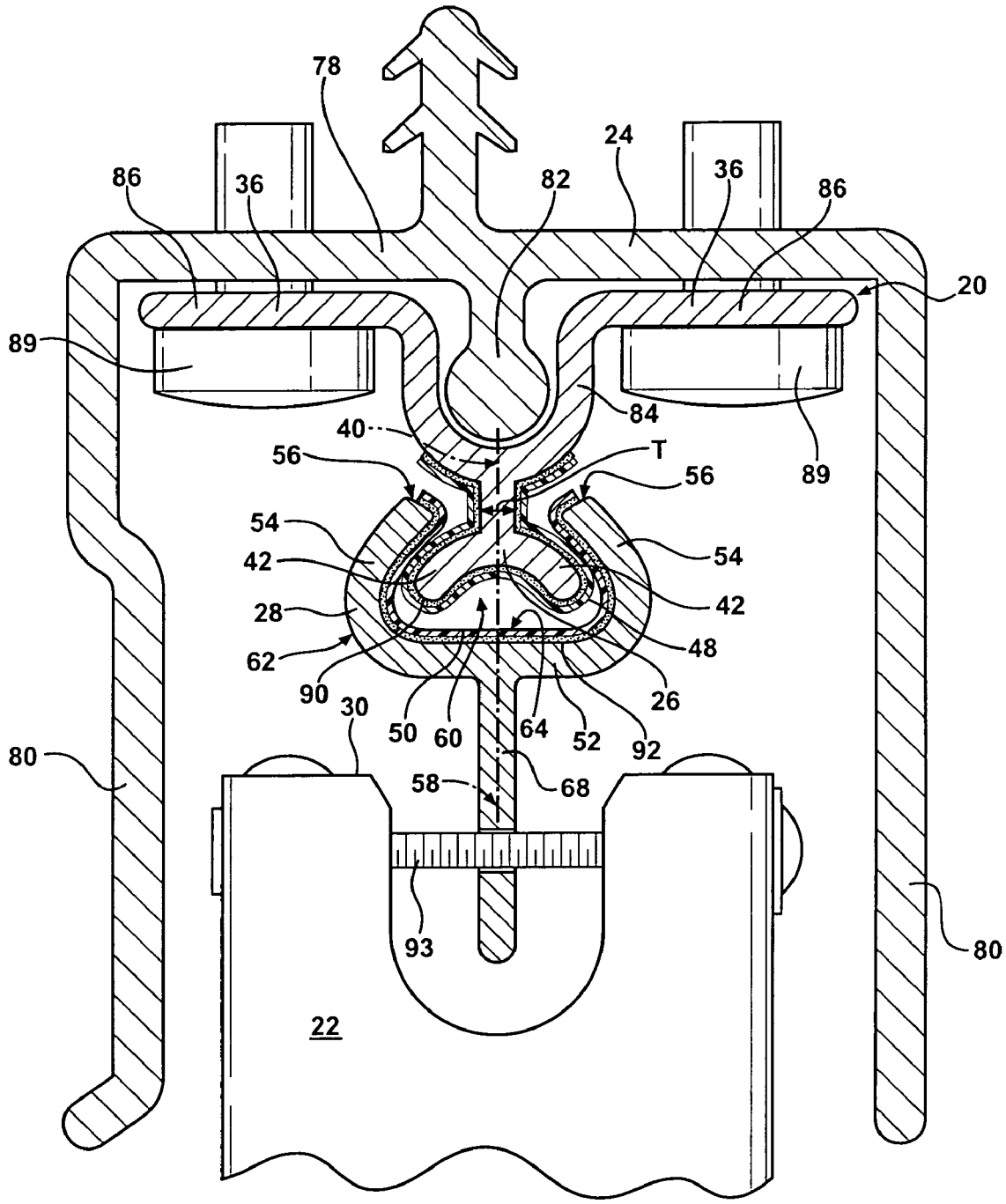
FIG. 2 is a partial cross-sectional end view of the sliding rail assembly mounted to the track and the sliding panel with a first layer of polymeric material adhesively secured to a runner of the sliding rail assembly by a first adhesive and a second layer of polymeric material adhesively secured to a glide of the sliding rail assembly by a second adhesive.
Figure 3:
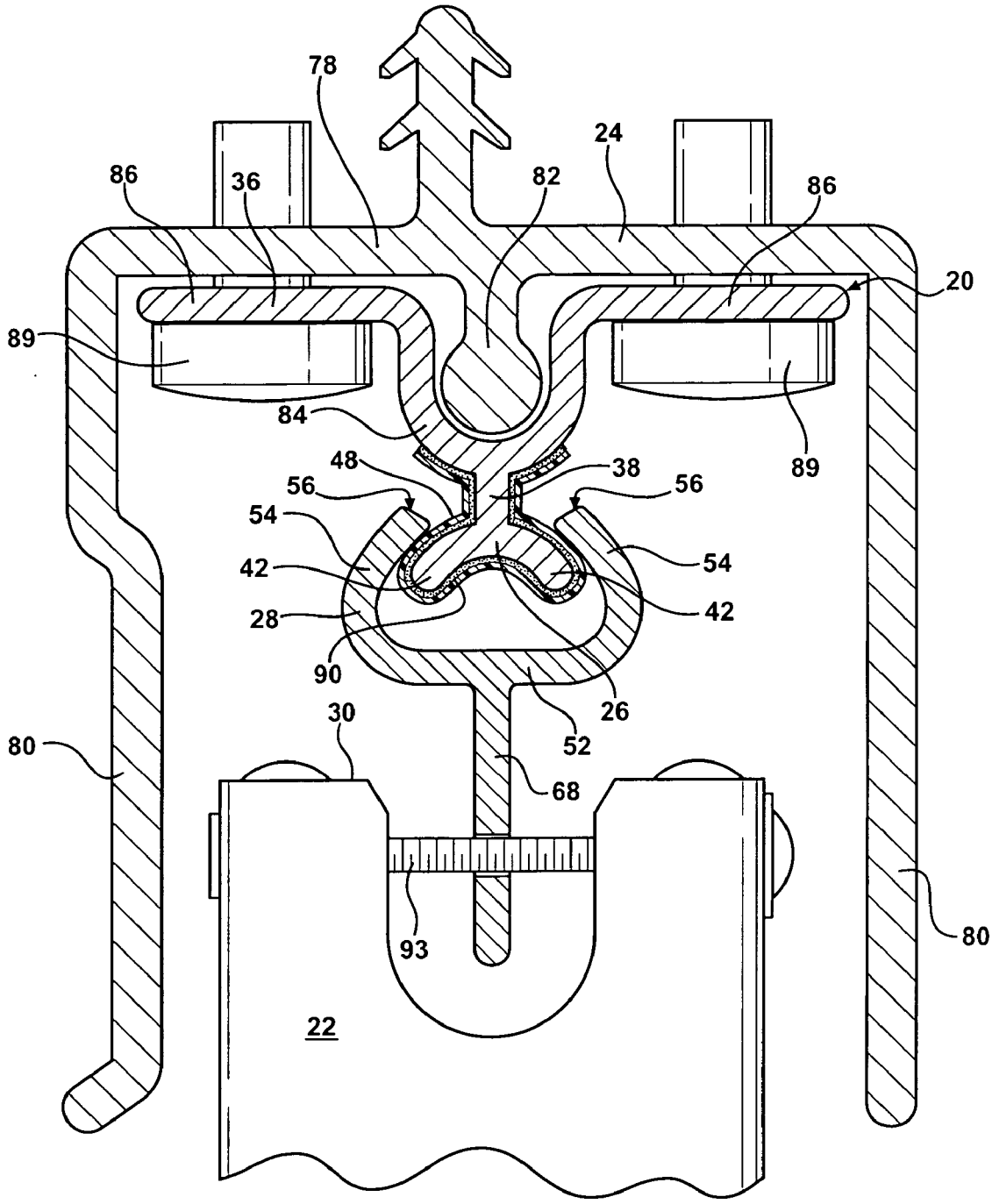
FIG. 3 is a partial cross-sectional end view of an alternative embodiment with the sliding rail assembly mounted to the track and the sliding panel with the first layer of polymeric material adhesively secured to the runner of the sliding rail assembly by the first adhesive.
Figure 4:
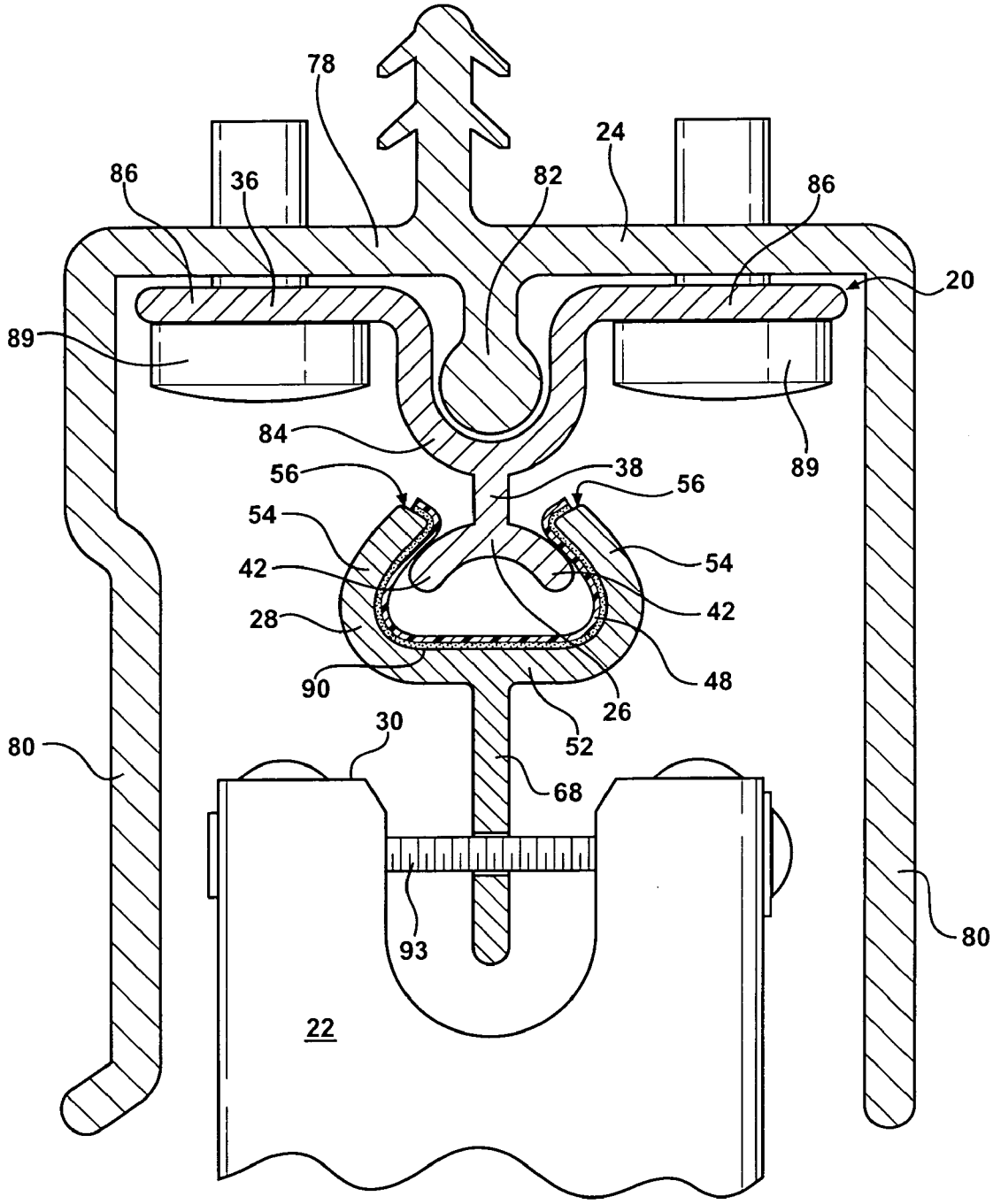
FIG. 4 is a partial cross-sectional end view of another alternative embodiment with the sliding rail assembly mounted to the track and the sliding panel with the first layer of polymeric material adhesively secured to the glide of the sliding rail assembly by the first adhesive.
Figure 5:
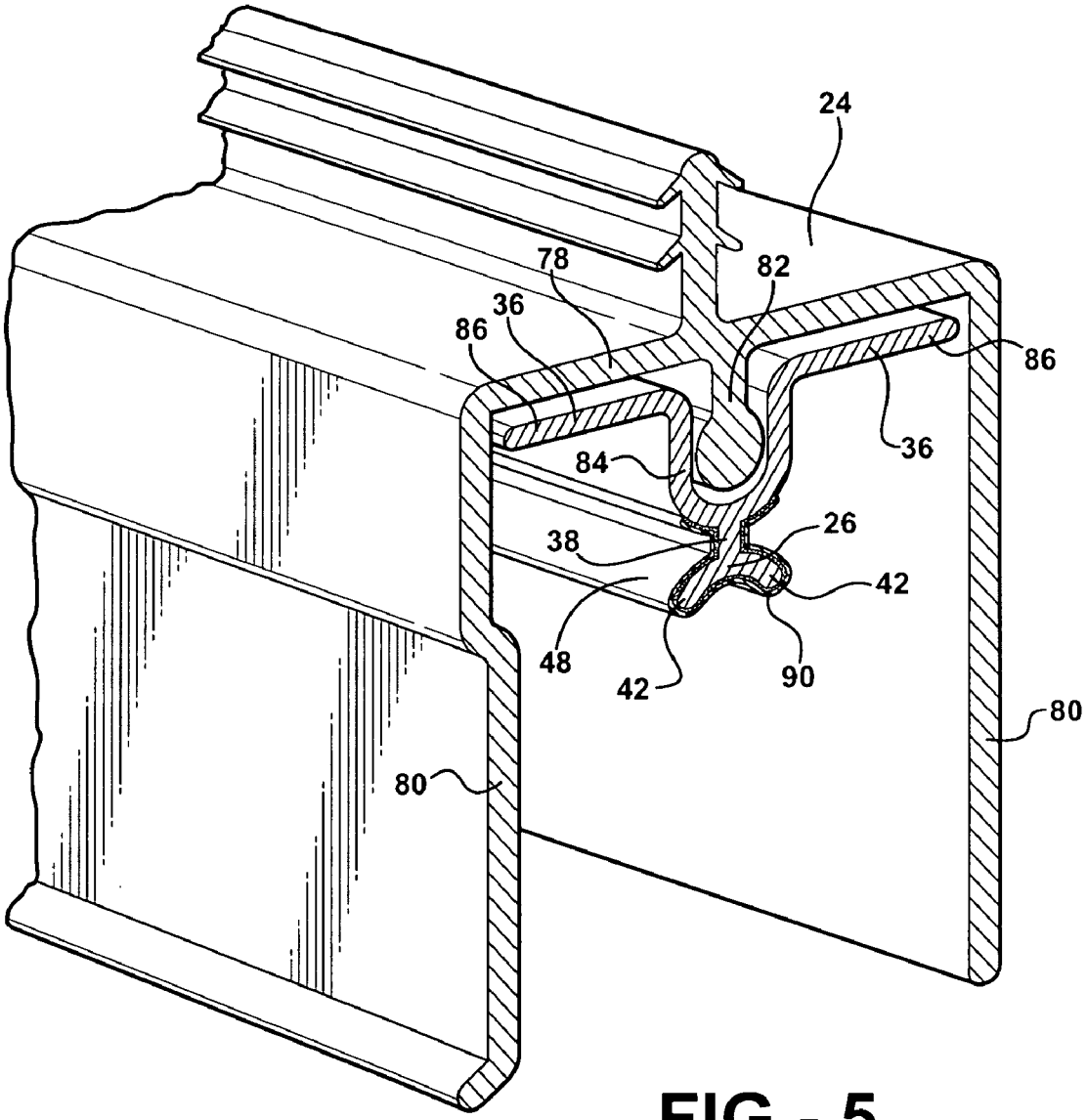
FIG. 5 is a cross-sectional perspective view of a mounting platform, a post, and a runner of the sliding rail assembly mounted to the track with the first layer of polymeric material adhesively secured to the runner by the first adhesive.
Figure 7:
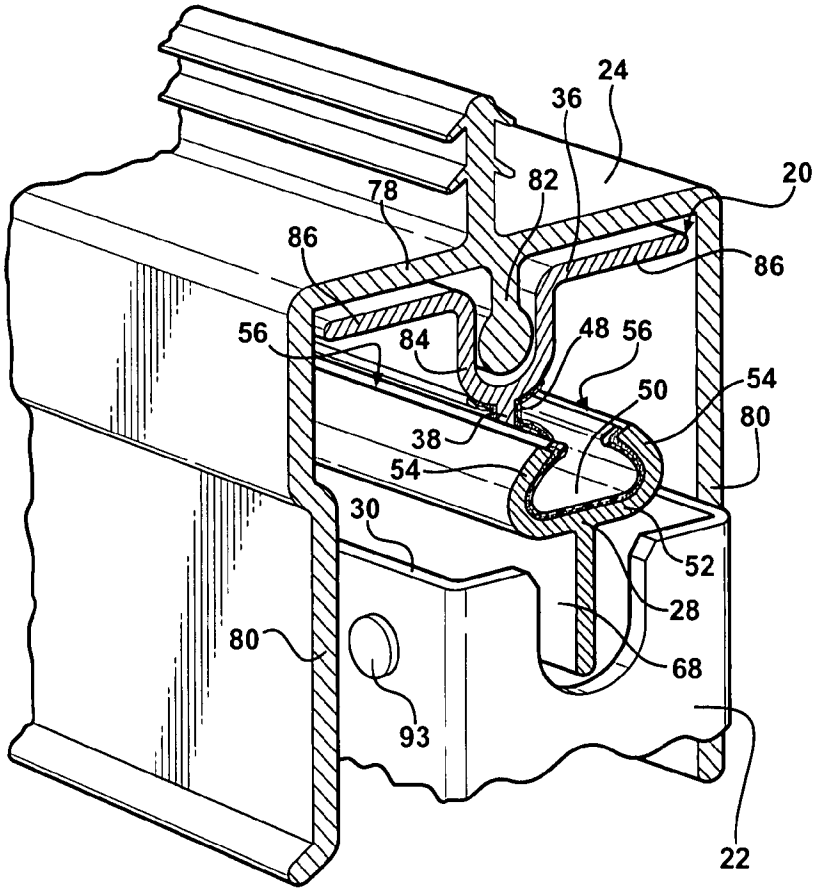
FIG. 7 is a partial cross-sectional perspective view of the sliding rail assembly of FIG. 6 illustrating the glide and the second layer of polymeric material sliding along rail and the first layer of polymeric material.
Figure 6:
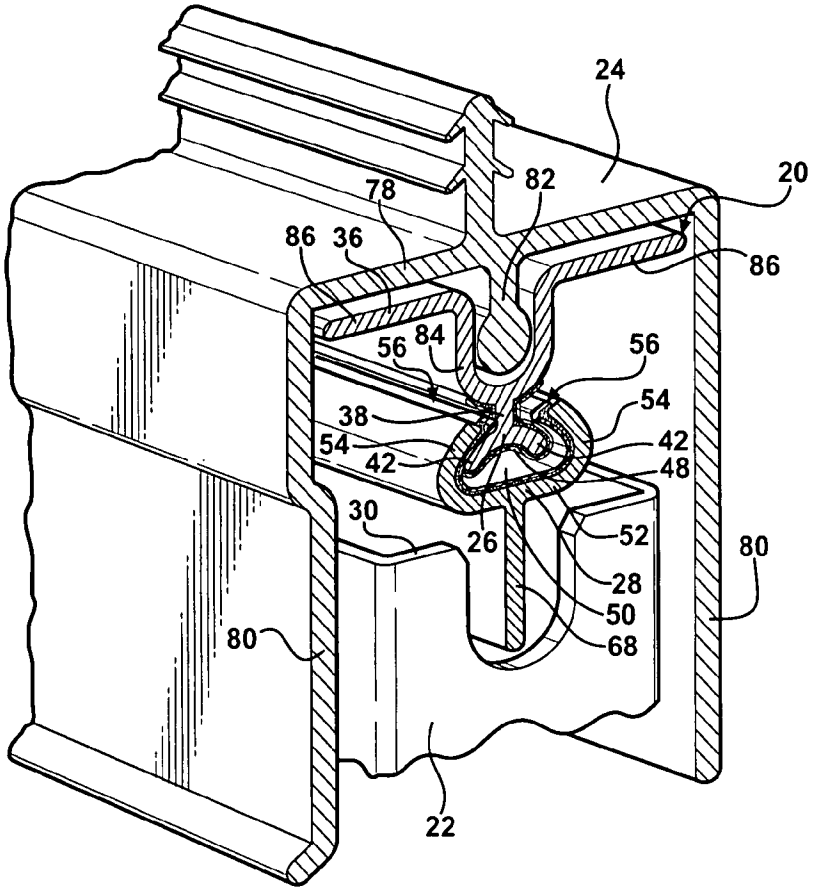
FIG. 6 is a partial cross-sectional perspective view of the sliding rail assembly including the first layer of polymeric material adhesively secured to the runner with the first adhesive and the second layer of polymeric material adhesively secured to the glide with the second adhesive.
Figure 10:
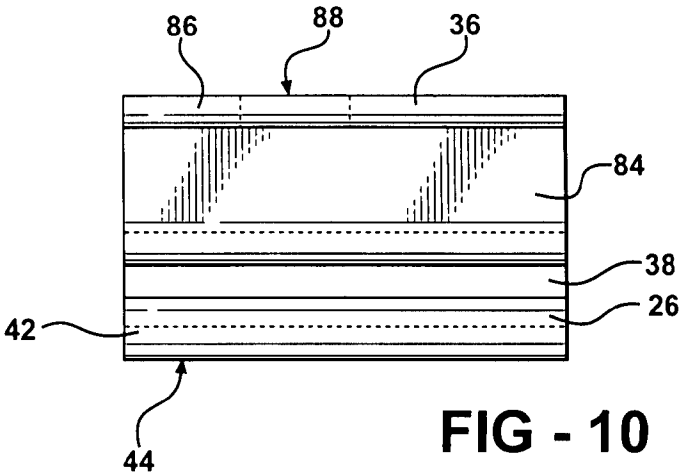
FIG. 10 is a side view of the mounting platform, the post, and the runner.
Figure 11:
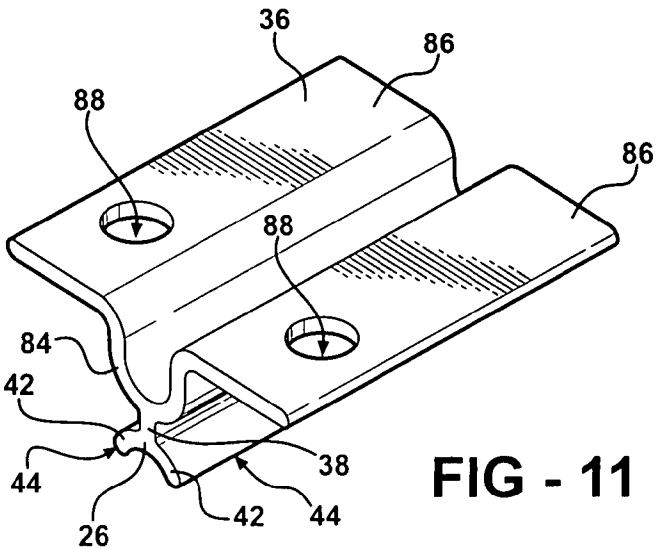
FIG. 11 is a perspective view of the mounting platform, the post, and the runner.
Figure 8:
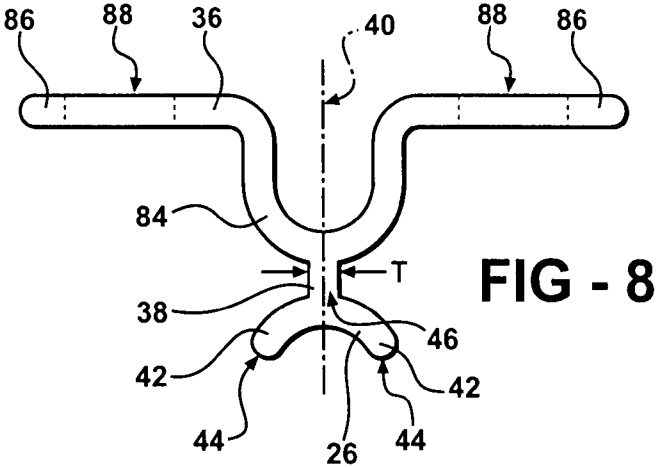
FIG. 8 is an end view of the mounting platform, the post, and the runner.
Figure 9:
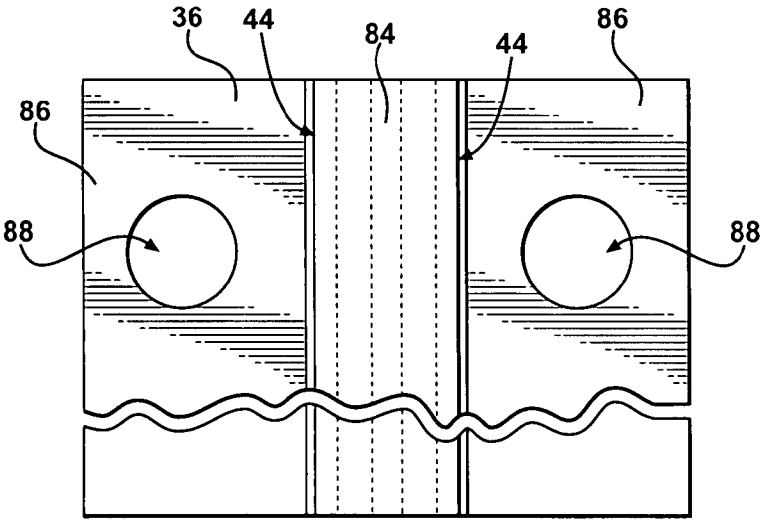
FIG. 9 is a bottom view of the mounting platform, the post, and the runner.

To facilitate sliding movement of the glide 28 along the runner 26, a first layer of polymeric material 48 is secured to at least one of the runner 26, as shown in FIG. 3, or the interior surface 64 of the glide 28, as shown in FIG. 4. To further facilitate sliding movement of the glide 28 along the runner 26, a second layer of polymeric material 50 is secured to the other one of the interior surface 64 of the glide 28 and the runner 26. For illustrative purposes, the first layer of polymeric material 48 is secured to the runner 26 and the second layer of polymeric material 50 is secured to the interior surface 64 of the glide 28, as shown in FIGS. 2, 6, 7, 15, and 16. In addition, the first or the second layer of polymeric material 48, 50 is preferably applied to at least a portion of the post 38 and at least a portion of the ends 56 of the glide 28 to further facilitate sliding movement of the glide 28 along the runner 26. The respective layer of polymeric material 48, 50 is extruded onto the interior surface 64 and the ends 56 of the glide 28 or the runner 26 and the post 38 using an extrusion process. The layers of polymeric material 48, 50 are usually extruded in conjunction with roll forming of the mounting platform 36, the post 38, and the runner 26 or the glide 28 and the flange 68. An example of extruding layers of polymeric material 48, 50 in conjunction with roll forming of the components is known as Rolltrusion®. However, the application of the polymeric material 48, 50 onto the interior surface 64 of the glide 28 and the runner 26 is not limited to being extruded in conjunction with the roll forming process or as an extrusion, but may include any suitable application process and order of application.

At least one of the first and the second layers of polymeric material 48, 50 comprises a polyamide and/or a thermoplastic material. Although the first and the second polymeric materials 48, 50 may be different, they are typically identical. One preferred type of polyamide is a nylon, such as nylon-6 or nylon-6,6. Although not required, the polyamide may include homopolymers, copolymers, and combinations thereof. However, the polyamide is not limited to these types of polymers, but may include any suitable type of polymer which facilitates sliding movement of the sliding rail assembly 20. One preferred type of thermoplastic material is polyvinyl chloride (PVC). However, the thermoplastic material is not limited to this type of thermoplastic material, but may include any suitable type of thermoplastic material which facilitates sliding movement of the sliding rail assembly 20.

To ensure that the first or the second layer of polymeric material 48, 50 is secured to the interior surface 64 of the glide 28 or the runner 26, a first or a second adhesive 90, 92 is used. The first and the second adhesives 90, 92 act as a tie-layer to secure the first layer of polymeric material 48 to the runner 26 or the second layer of polymeric material 50 to the interior surface 64 of the glide 28. Therefore, the first adhesive 90 is disposed between the first layer of polymeric material 48 and the runner 26 for adhesively securing the first layer of polymeric material 48 to the runner 26. Likewise, the second adhesive 92 is disposed between the second layer of polymeric material 50 and the interior surface 64 of the glide 28 for adhesively securing the second layer of polymeric material 50 to the interior surface 64 of the glide 28. This means that the first adhesive 90 is disposed between the first layer of polymeric material 48 and the second adhesive 92 is disposed between the second layer of polymeric material 50 and the interior surface 64 of the glide 28. However, it should be understood that if the first layer of polymeric material 48 is secured to the runner 26, instead of to the interior surface 64 of the glide 28, the first adhesive would instead be disposed between the first layer of polymeric material 48 and the runner 26. Additionally, if the layers of polymeric material 48, 50 are secured to at least a portion of either the post 38 or the ends 56, the adhesives 90, 92 may similarly be disposed between the layers of polymeric material 48, 50 and the respective post 38 and ends 56.

The first or the second adhesive 90, 92 is preferably applied between the respective first and second layers of polymeric material 48, 50 and the interior surface 64 of the glide 28 or the runner 26 during the Rolltrusion® process. This means that as the first or the second layer of polymeric material 48, 50 is being extruded, the first or the second adhesive 90, 92 is extruded such that it is between the respective first or second layers of polymeric material 48, 50 and the interior surface 64 of the glide 28 or the runner 26. However, the method of securing the first or the second layer of polymeric material 48, 50 is not limited to being extruded and includes any acceptable method of applying the first or the second adhesives 90, 92.

Preferably, the first adhesive 90 is a thermoplastic elastomer (TPE), more preferably a thermoplastic vulcanizate (TPV). Non-limiting examples of preferred TPVs for use in the present invention are those that are commercially available from Advanced Elastomer Systems, of Akron, Ohio, under their line of Santoprene® TPVs. It is to be understood that the TPV is a TPE having a rubber-like phase that is chemically cross-linked. Although not required, the TPV is typically produced by a dynamic vulcanization process where a thermoplastic polymer is melt mixed with a suitable reactive, rubber-like polymer. As alluded to above, the first adhesive 90, preferably the TPV, functions as a tie-layer to adhesively bond the first layer of polymeric material 48 to the interior surface 64 of the glide 28, to the runner 26, or both the interior surface 64 and the runner 26. The preceding description in this paragraph for the first adhesive 90 also applies to the second adhesive 92.

The sliding panel 22 is attached to the sliding rail assembly 20 by attaching the sliding panel 22 to the flange 68. The sliding panel 22 is attached to the sliding rail assembly 20 in different orders of attachment. In one order of attachment, the sliding panel 22 is attached to the glide 28 prior to attachment of the mounting platform 36, the post 38, and the runner 26 to the track 24. Therefore, the sliding panel 22, along with sliding rail assembly 20, is attached to the track 24 as an entire unit. As an alternative order of attachment, the sliding rail assembly 20 is attached to the track 24 without the sliding panel 22. Next, the sliding panel 22 is attached to the glide 28. Regardless of the orders of attachment, the mounting platform 36 to the track 24, attachment fasteners 93 are inserted through the mounting hole 88 and into the track 24.

Referring to FIG. 1, a guide rail 94, which is in spaced and parallel relationship to the track 24, is typically mounted to the bottom of the surround 96, opposite the track 24. However, the guide rail 94 for guiding the sliding panel 22 is not a requirement. The guide rail 94 functions as a guide for the sliding panel 22 as the sliding panel 22 moves across the track 24. This means that the guide rail 94 keeps the bottom 32 of the sliding panel 22 from swinging beyond the opening 34 with respect to the runner 26 and the track 24. The guide rail 94 is any number of shapes. For example, the guide rail 94 has the same U-shaped cross section as the track 24, including the guide ridge 82. The rollers would be attached to the bottom 32 of the sliding panel 22 for straddling and rolling across the guide ridge 82 to guide the bottom 32 of the sliding panel 22 as the sliding rail assembly 20 supports the sliding panel 22 at the top 30 of the sliding panel 22. If rollers are not used, a bar defining a U-shaped slot is attached to the bottom 32 of the sliding panel 22 for straddling the guide ridge 82 to guide the sliding panel 22 as the sliding rail assembly 20 supports the sliding panel 22. However, the guide rail 94 is not limited to this shape and configuration for guiding the sliding panel 22, and is any suitable shape and configuration which facilitates guiding the sliding panel 22 across the opening 34.

Sometimes, the sliding panel 22 and the glide 28 require rotational movement with respect to the runner 26 and the track 24. This rotational movement may be required when attaching the sliding rail assembly 20, along with the sliding panel 22, to the track 24. Alternatively, the rotational movement may be required when attaching the sliding panel 22 to the sliding rail assembly 20 which was previously mounted to the track 24. For example, the rotational movement may be required when the second axis 58 and the glide 28 need to be rotated out of alignment with the first axis 40 and the runner 26 to provide access to the attachment holes 70 for inserting the attachment fasteners 93 through the sliding panel 22 and the flange 68 to attach the sliding panel 22 to the sliding rail assembly 20. As another example, the bottom 32 of the sliding panel 22 can be swung into alignment with the guide rail 94 after the top 30 of the sliding panel 22 and the sliding rail assembly 20 is attached to the track 24. This allows the rollers, for example, to then be attached to the bottom 32 of the sliding panel 22 while the top 30 of the sliding panel 22 is attached to the sliding rail assembly 20. If, then, for any reason, the rollers need to be replaced during the use of the sliding panel 22 the bottom 32 of the sliding panel 22 can be rotated with respect to the sliding rail assembly 20 and replaced without completely removing the sliding panel 22 from within the surround 72. However, the reasons for requiring rotational movement are not limited to these examples and can include any reason which would require rotational movement of the glide 28 with respect to the runner 26.

Figure 16:
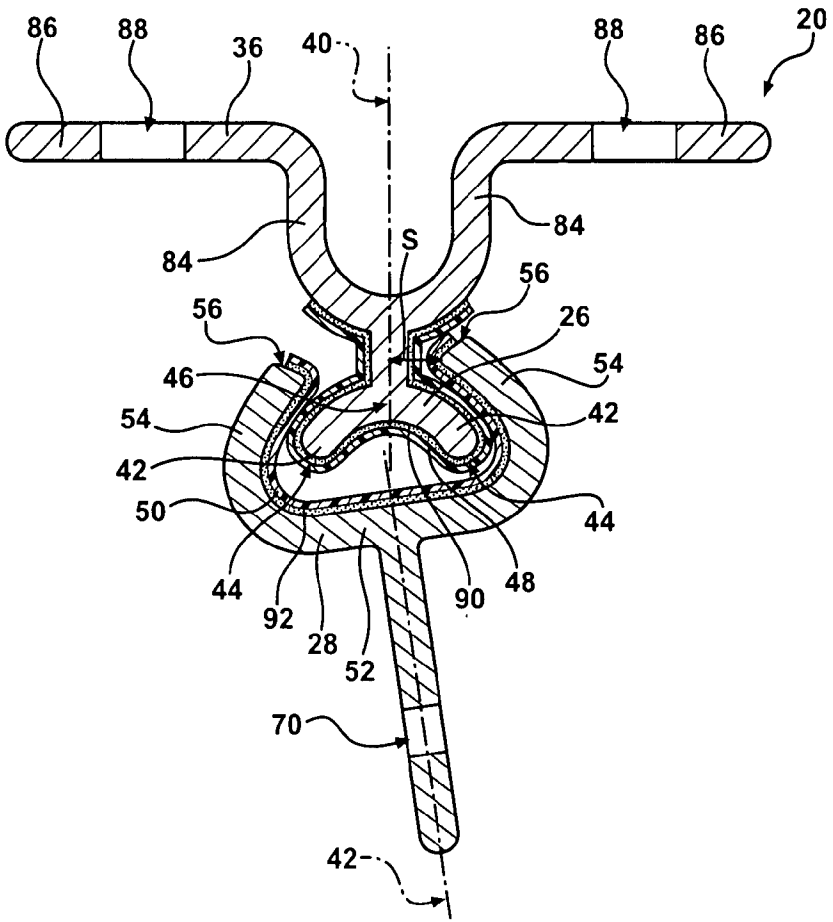
FIG. 16 is a cross-sectional end view of the sliding rail assembly showing the second axis and the glide rotated with respect to the first axis and the runner.
Figure 15:
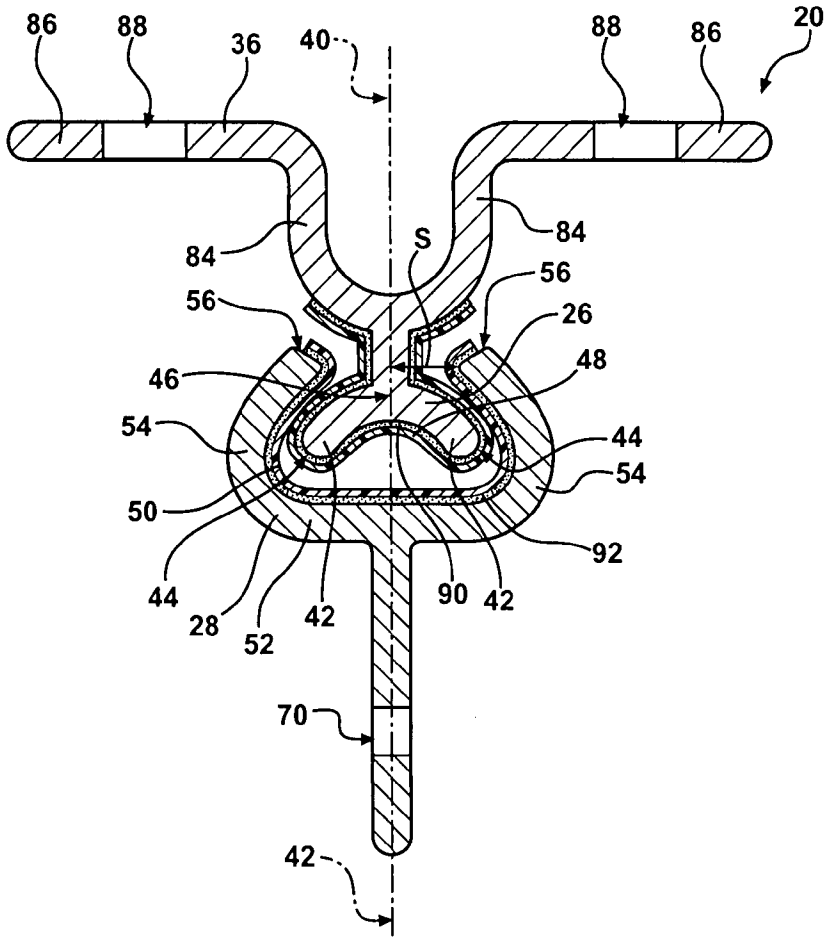
FIG. 15 is a cross-sectional end view of the sliding rail assembly showing a first axis of the runner and a second axis of the glide aligned.

To facilitate rotational movement, the ends 56 and the first axis 40 define a space S between each of the ends and the first axis 40 such that the glide 28 and the second axis 58 can rotate with respect to the runner 26 and the first axis 40. The post 38 includes a thickness T and the ends 56 of the glide 28 define a width W as the shortest distance between the ends 56. The hooks 54 define the slot 66, which is equal to the width W. The slot 66 extends into the C-shaped cavity 60 and the post 38 extends through the slot 66 and between the hooks 54 when the runner 26 is inside the C-shaped cavity 60. A gap G is defined as the shortest distance between one of the tips 44 and the base 52. When the thickness T is less than the width W, the thickness T, the width W, and the gap G cooperate such that the glide 28 and the second axis 58 can rotate with respect to the runner 26 and the first axis 40. Rotational movement occurs when the glide 28 and the second axis 58 are rotated with respect to the arcs 42 of the runner 26 and the first axis 40 such that the first axis 40 can be misaligned relative to the second axis 58, as shown in FIG. 15. Once the bottom 32 of the sliding panel 22 is brought into alignment with the guide rail 94, for example, the first and the second axes 40, 58 are aligned, as shown in FIG. 16, and the glide 28 is at least partially encapsulating the runner 26 and the hooks 54 are disposed about the arcs 42. Therefore, when the first and the second axes 40, 58 are not aligned, the glide 28 does not necessarily partially encapsulate the runner 26 such that both of the ends 56 are disposed about the arcs 42. This means that the glide 28 may not be disposed about both of the arcs 42 when the axes 40, 58 are not aligned.

Figure 17:
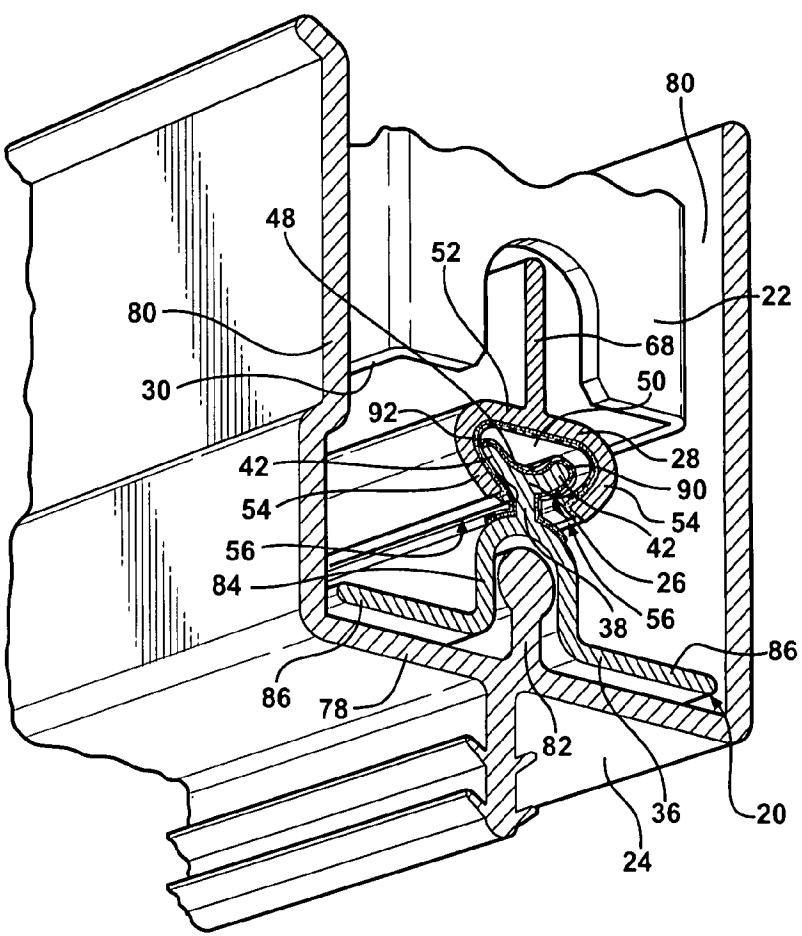
FIG. 17 is a cross-sectional perspective view of an alternative embodiment of FIG. 6 showing the sliding rail assembly attached to the track which is inverted and mounted to a bottom of the surround and a bottom of the sliding panel.
Figure 13:
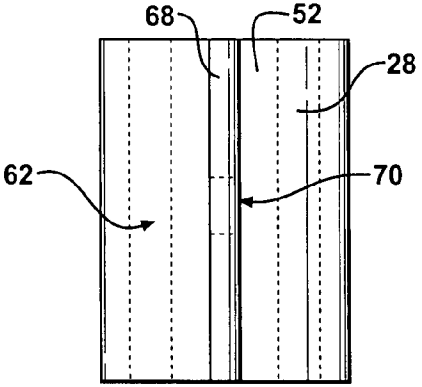
FIG. 13 is a bottom view of the glide and the flange.
Figure 14:
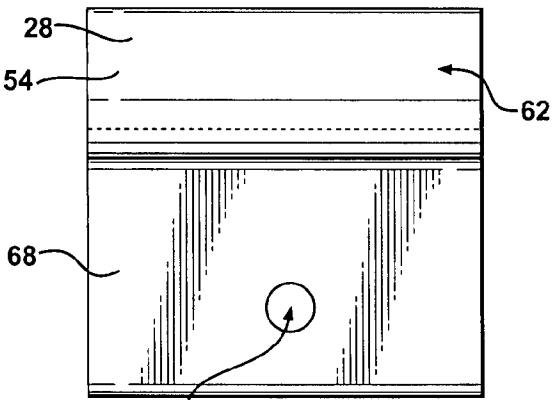
FIG. 14 is a side view of the glide and the flange.
Figure 12:
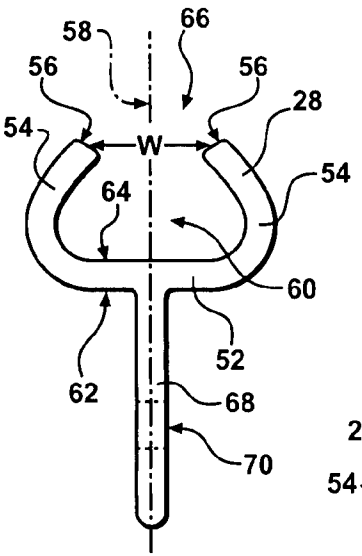
FIG. 12 is an end view of the glide and a flange.

Referring again to FIG. 17, the sliding rail assembly 20 is not limited to supporting the glide 28 and the top 30 of the sliding panel 22. This means that the sliding rail assembly 20 may be attached to a track 24 positioned at the bottom of the surround 96, such that the sliding rail assembly 20 and the track 24 are inverted. Accordingly, the weight of the sliding rail assembly 20 and the glide 28 are bearing down onto the runner 26. Therefore, if the guide rail 94 is used, the guide rail 94 is positioned at the top of the surround 95 instead of at the bottom of the surround 96 as described in the previous embodiments.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A sliding rail assembly (20) for a sliding panel (22) movable along a track (24) between open and closed positions, said sliding rail assembly (20) comprising;

a runner (26) adapted to extend from the track (24), a glide (28) presenting a cross-section having an exterior surface (62) adapted to extend from the sliding panel (22) and an interior surface (64) with said interior surface (64) disposed about said runner (26) for sliding engagement along said runner (26), a first layer of polymeric material (48) secured to at least one of said interior surface (64) of said glide (28) and said runner (26) for facilitating sliding movement of said glide (28) along said runner (26), and a first adhesive (90) disposed between said first layer of polymeric material (48) and said at least one of said interior surface (64) of said glide (28) and said runner (26) for adhesively securing said first layer of polymeric material (48) to said at least one of said interior surface (64) of said glide (28) and said runner (26).

2. A sliding rail assembly (20) as set forth in claim 1 wherein said first adhesive (90) comprises a thermoplastic vulcanizate.

3. A sliding rail assembly (20) as set forth in claim 1 further comprising a second layer of polymeric material (50) secured to said other one of said interior surface (64) of said glide (28) and said runner (26) for facilitating sliding movement of said glide (28) along said runner (26).

4. A sliding rail assembly (20) as set forth in claim 3 further comprising a second adhesive (92) disposed between said second layer of polymeric material (50) and said other one of said interior surface (64) of said glide (28) and said runner (26) for adhesively securing said second layer of polymeric material (50) to said other one of said interior surface (64) of said glide (28) and said runner (26).

5. A sliding rail assembly (20) as set forth in claim 4 wherein at least one of said adhesives (90, 92) comprises a thermoplastic elastomer.

6. A sliding rail assembly (20) as set forth in claim 4 wherein at least one of said adhesives (90, 92) comprises a thermoplastic vulcanizate.

7. A sliding rail assembly (20) as set forth in claim 3 wherein at least one of said layers of polymeric material (48, 50) comprises a polyamide.

8. A sliding rail assembly (20) as set forth in claim 3 wherein at least one of said layers of polymeric material (48, 50) comprises nylon.

9. A sliding rail assembly (20) as set forth in claim 3 wherein at least one of said layers of polymeric material (48, 50) comprises a thermoplastic material.

10. A sliding rail assembly (20) as set forth in claim 4 wherein said adhesives (90, 92) comprise the same adhesive (90).

11. A sliding rail assembly (20) as set forth in claim 1 wherein said interior surface (64) of said glide (28) at least partially encapsulates said runner (26).

12. A sliding rail assembly (20) as set forth in claim 1 wherein said cross-section of said glide (28) is further defined as a C-shaped cross-section having a C-shaped cavity (60).

13. A sliding rail assembly (20) as set forth in claim 1 further comprising a mounting platform (36) adapted to extend from the track (24) with said runner (26) extending from said mounting platform (36).

14. A sliding rail assembly (20) as set forth in claim 13 wherein said mounting platform (36) includes a center arch (84) and side feet (86) as viewed in cross-section for disposition of said arch over a guide ridge (82) in the track (24).

15. A sliding rail assembly (20) as set forth in claim 13 further comprising a post (38) interconnecting said mounting platform (36) and said runner (26).

16. A sliding rail assembly (20) as set forth in claim 1 wherein said runner (26) presents an arcuate cross-section having an arcuate shape.

17. A sliding rail assembly (20) as set forth in claim 1 further comprising a flange (68) extending from said exterior surface (62) of said glide (28) for attaching said glide (28) to the sliding panel (22).

18. A sliding rail assembly (20) as set forth in claim 1 wherein said glide (28) is suspended from said runner (26).

19. A sliding rail assembly (20) for a sliding panel (22) movable along a track (24) between open and closed positions, said sliding rail assembly (20) comprising;

a runner (26) adapted to extend from the track (24) with said runner (26) extending along a first axis (40) and including a pair of arcs (42) presenting an arcuate cross-section with said arcs (42) extending in opposite directions transverse to said first axis (40) with said first axis (40) bisecting said arcs (42), a glide (28) adapted to extend from the sliding panel (22) and presenting a C-shaped cross-section having two opposing ends (56) with said glide (28) defining a C-shaped cavity (60), said glide (28) having an exterior surface (62) and an interior surface (64) with said interior surface (64) facing said C-shaped cavity (60), a second axis (58) bisecting said C-shaped cross-section of said glide (28), and said glide (28) at least partially encapsulating said runner (26) with said ends (56) disposed about said arcs (42), and said ends (56) being rotatable about said arcs (42) such that said first axis (40) can be aligned or misaligned relative to said second axis (58).

20. A sliding rail assembly (20) as set forth in claim 19 wherein said ends (56) and said first axis (40) define a space between each of said ends (56) and said first axis (40) such that said glide (28) and said second axis (58) can rotate with respect to said runner (26) and said first axis (40).

21. A sliding rail assembly (20) as set forth in claim 19 further comprising a post (38) extending along said first axis (40) from said runner (26) adapted to extend from the track (24).

22. A sliding rail assembly (20) as set forth in claim 21 wherein said post (38) further comprises a thickness (T) and said ends (56) of said glide (28) define a width (W) as the shortest distance between said ends (56) with said thickness (T) being less than said width (W) and said post (38) extends between said ends (56) such that said glide (28) and said second axis (58) can rotate with respect to said runner (26) and said first axis (40).

23. A sliding rail assembly (20) as set forth in claim 19 wherein said arcs (42) extend to a respective tip (44) and said glide (28) is further defined as including a base (52) and a pair of hooks (54) extending from said base (52) to said ends (56) and said hooks (54) defining said C-shaped cavity (60) with said base (52) and said hooks (54) and said interior surface (64) facing said C-shaped cavity (60).

24. A sliding rail assembly (20) as set forth in claim 23 further comprising a gap (G) defined as the shortest distance between said tips (44) and said base (52) such that said glide (28) and said second axis (58) can rotate with respect to said runner (26) and said first axis (40).

25. A sliding rail assembly (20) as set forth in claim 19 further comprising a first layer of polymeric material (48) secured to at least one of said interior surface (64) of said glide (28) and said arcs (42) of said runner (26) for facilitating sliding movement of said glide (28) along said runner (26).

26. A sliding rail assembly (20) as set forth in claim 25 further comprising a first adhesive (90) disposed between said first layer of polymeric material (48) and said at least one of said interior surface (64) of said glide (28) and said arcs (42) of said runner (26) for adhesively securing said first layer of polymeric material (48) to said at least one of said interior surface (64) of said glide (28) and said arcs (42) of said runner (26) with said first adhesive (90) comprising a thermoplastic vulcanizate.

27. A sliding rail assembly (20) for a sliding panel (22) movable along a track (24) between open and closed positions, said sliding rail assembly (20) comprising;

a runner (26) adapted to extend from the track (24), a glide (28)presenting a C-shaped cross-section having a C-shaped cavity (60) with said slide having an exterior surface (62) adapted to extend from the sliding panel (22) and an interior surface (64) with said interior surface (64) disposed about said runner (26) for sliding engagement along said runner (26), a first layer of polymeric material (48) secured to at least one of said interior surface (64) of said glide (28) and said runner (26) for facilitating sliding movement of said glide (28) along said runner (26), and a first adhesive (90) disposed between said first layer of polymeric material (48) and said at least one of said interior surface (64) of said glide (28) and said runner (26) for adhesively securing said first layer of polymeric material (48) to said at least one of said interior surface (64) of said glide (28) and said runner (26), wherein said slide (28) includes a base (52) and a pair hooks (54) extending from said base (52) in a spaced and mirrored relationship to respective ends (56) thereof with said base (52) and said hooks (54) and said interior surface (64) facing said C-shaped cavity (60) and said hooks (54) defining a slot (66) extending into said C-shaped cavity (60).

28. A sliding rail assembly (20) as set forth in claim 27 wherein said runner (26) includes a midpoint (46) and a pair of arcs (42) extending in opposite directions from said midpoint (46) with said arcs (42) supporting said hooks (54) of said glide (28).

29. A sliding rail assembly (20) as set forth in claim 28 further comprising a post (38) for connecting said runner (26) to the track with said post (38) extending from said midpoint (46) of said runner (26) and said arcs (42) extending from said midpoint (46) transverse to said post (38) with said post (38) extending through said slot (66) and said runner (26) being disposed in said C-shaped cavity (60) with said arcs (42) supporting said hooks (54) of said glide (28).

30. A sliding rail assembly (20) as set forth in claim 28 wherein said arcs (42) curve away from the track (24) when said runner (26) is attached to the track (24).

* * * * *

UNITED STATES PATENT AND TRADEMARK OFFICE

CERTIFICATE OF CORRECTION

PATENT NO. : 7,653,966 B2
APPLICATION NO. : 11/405813
DATED : February 2, 2010
INVENTOR(S) : Quinn et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 836 days.

Signed and Sealed this

Twenty-third Day of November, 2010

David J. Kappos

David J. Kappos
*Director of the United States Patent and Trademark Office*